US010820073B2

(12) United States Patent
Shan et al.

(10) Patent No.: US 10,820,073 B2
(45) Date of Patent: Oct. 27, 2020

(54) SPEAKER BOX

(71) Applicant: AAC Technologies Pte. Ltd., Singapore (SG)

(72) Inventors: Wei Shan, Shenzhen (CN); Yue Ren, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 2 days.

(21) Appl. No.: 16/236,499

(22) Filed: Dec. 29, 2018

(65) Prior Publication Data

US 2019/0238959 A1 Aug. 1, 2019

(30) Foreign Application Priority Data

Jan. 30, 2018 (CN) ..... 2018 2 0171824 U

(51) Int. Cl.
*H04R 1/02* (2006.01)

(52) U.S. Cl.
CPC ..... *H04R 1/02* (2013.01); *H04R 2499/11* (2013.01)

(58) Field of Classification Search
CPC .. H04R 1/283; H04R 1/2834; H04R 2499/11; H04R 1/2811
See application file for complete search history.

(56) References Cited

U.S. PATENT DOCUMENTS 6,031,919 A * 2/2000 Funahashi ..... H04R 1/2842 181/145
6,396,936 B1 * 5/2002 Nevill ..... H04R 1/2834 181/156
7,643,747 B2 * 1/2010 Cha ..... G03B 19/00 396/280
8,565,463 B2 * 10/2013 Saiki ..... H04R 1/2811 381/345
9,681,217 B2 * 6/2017 Mihelich ..... H04R 1/2857
10,021,480 B2 * 7/2018 Lobisser ..... H04R 1/2888
10,110,990 B2 * 10/2018 Litovsky ..... H04R 1/2834
10,117,018 B2 * 10/2018 Shao ..... H04R 1/2834
10,178,467 B2 * 1/2019 Hou ..... H04R 9/02
10,178,481 B2 * 1/2019 Shao ..... H04R 9/06
10,225,646 B2 * 3/2019 Qin ..... H04R 1/2888
(Continued)

FOREIGN PATENT DOCUMENTS

CN 107396257 A * 11/2017

*Primary Examiner* — Fan S Tsang
*Assistant Examiner* — Ryan Robinson
(74) *Attorney, Agent, or Firm* — IPro, PLLC; Na Xu

(57) ABSTRACT

The present disclosure relates to a speaker box. The speaker box includes a housing having a top wall, and a sounding unit accommodated in the housing. The sounding unit includes a diaphragm, which together with the top wall are disposed with a spacing therebetween to form a front acoustic cavity. The speaker box further includes a sound guiding channel. The front acoustic cavity and the sound guiding channel together constitute a front chamber of the speaker box. At least two first through-holes disposed with a spacing therebetween are provided in a region of the top wall corresponding to the front chamber. The speaker box further includes a cover plate provided on the top wall. The cover plate includes hard sheets covering the first through-holes and a soft rubber fixing portion, which surrounds and spaces the hard sheets from the top wall, and is fixedly connected with the top wall.

9 Claims, 6 Drawing Sheets

(56) References Cited

U.S. PATENT DOCUMENTS

| | | | | |
|---|---|---|---|---|
| 10,341,780 | B2 * | 7/2019 | Wang | H04R 1/02 |
| 10,462,559 | B2 * | 10/2019 | Zhang | H04R 1/2888 |
| 10,469,953 | B2 * | 11/2019 | Qin | H04R 1/345 |
| 2008/0170736 | A1 * | 7/2008 | Yu | H04R 1/2834<br>381/345 |
| 2015/0304760 | A1 * | 10/2015 | Yeh | H04R 1/1058<br>381/370 |
| 2018/0242060 | A1 * | 8/2018 | Ji | H03G 5/005 |

* cited by examiner

SPEAKER BOX

CROSS-REFERENCE TO RELATED APPLICATIONS

The present application claims priority to Chinese Patent Application 201820171824.9, filed on Jan. 30, 2018, the content of which is incorporated herein by reference in its entirety.

TECHNICAL FIELD

The present disclosure relates to the field of electroacoustic conversion, and particularly to a speaker box used in portable electronic products.

BACKGROUND

With the rapid development of technology, the popularity of audio equipment is getting higher and higher. Among many recreational and entertainment manners, high-quality music enjoyment is gradually popularized. Therefore, a speaker box for playing audio is widely applied to the present smart mobile apparatuses.

The speaker box known in the related art includes a housing and a sounding unit accommodated in the housing. However, in the speaker box of the related art, since the housing is integrally molded with plastic, when the speaker is operated, the housing may vibrate therewith on the one hand, thereby affecting a sounding quality of the sounding unit; and on the other hand, a loudness of sound produced by the sounding unit in different frequency bands is not adjustable.

Therefore, it is necessary to provide a new speaker box to solve the above problems.

BRIEF DESCRIPTION OF DRAWINGS

In order to illustrate technical solutions in the embodiments of the present disclosure, the drawings used in the description of the embodiments will be briefly introduced below. It is obvious that the drawings in the following description merely show some embodiments of the present disclosure, and those skilled in the art can obtain other drawings according to these drawings without any creative efforts.

DESCRIPTION OF EMBODIMENTS

The technical solutions in the embodiments of the present disclosure will be described in detail in conjunction with the accompany drawings of the embodiments of the present disclosure. It is obvious that the described embodiments are only part of the embodiments of the present disclosure, but not all of the embodiments. All other embodiments obtained by those skilled in the art based on the embodiments of the present disclosure without creative efforts fall within the scope of the present disclosure.

Figure 1:
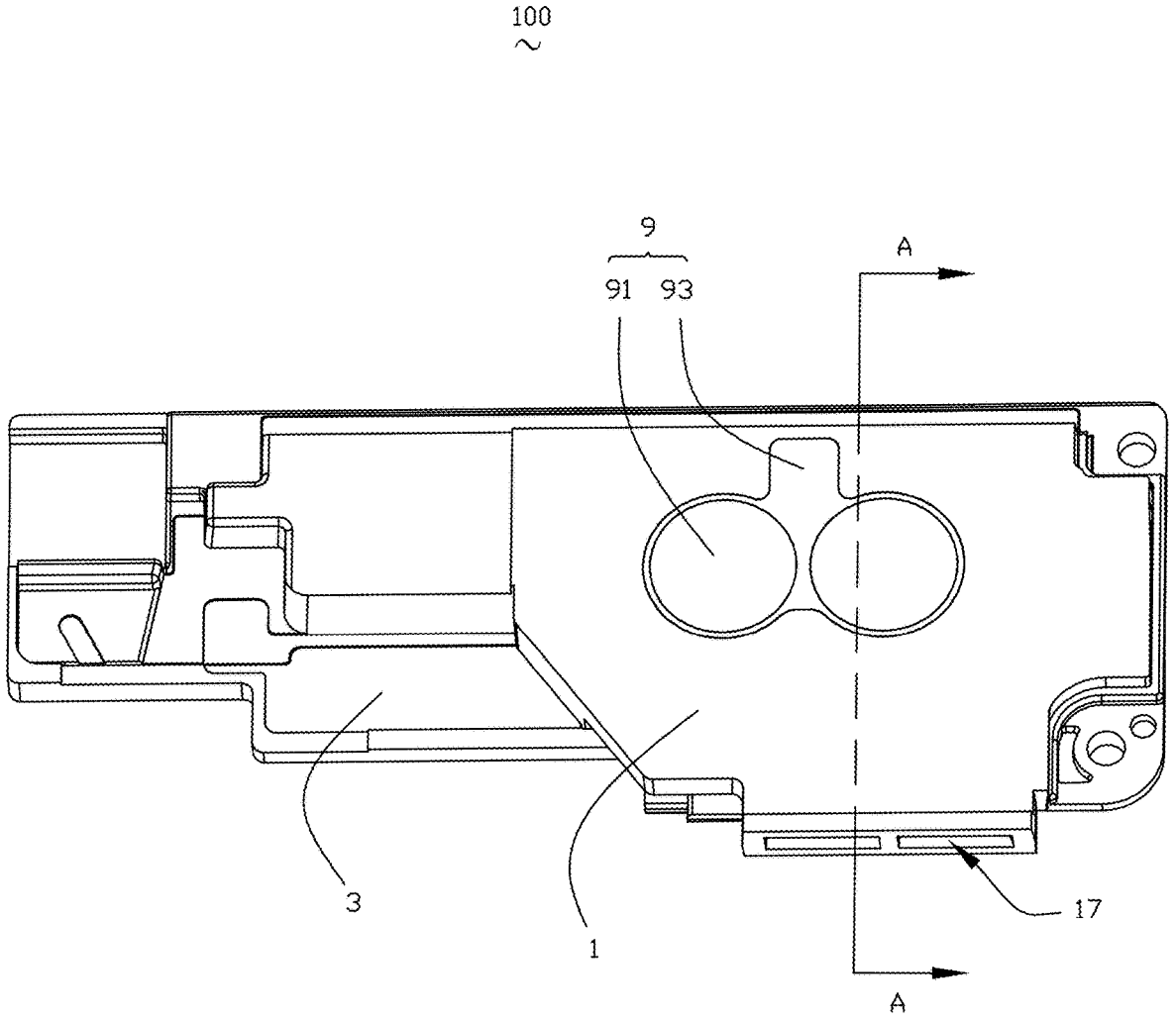
FIG. 1 is a perspective assembly schematic diagram of a speaker box provided by the present disclosure.
Figure 2:
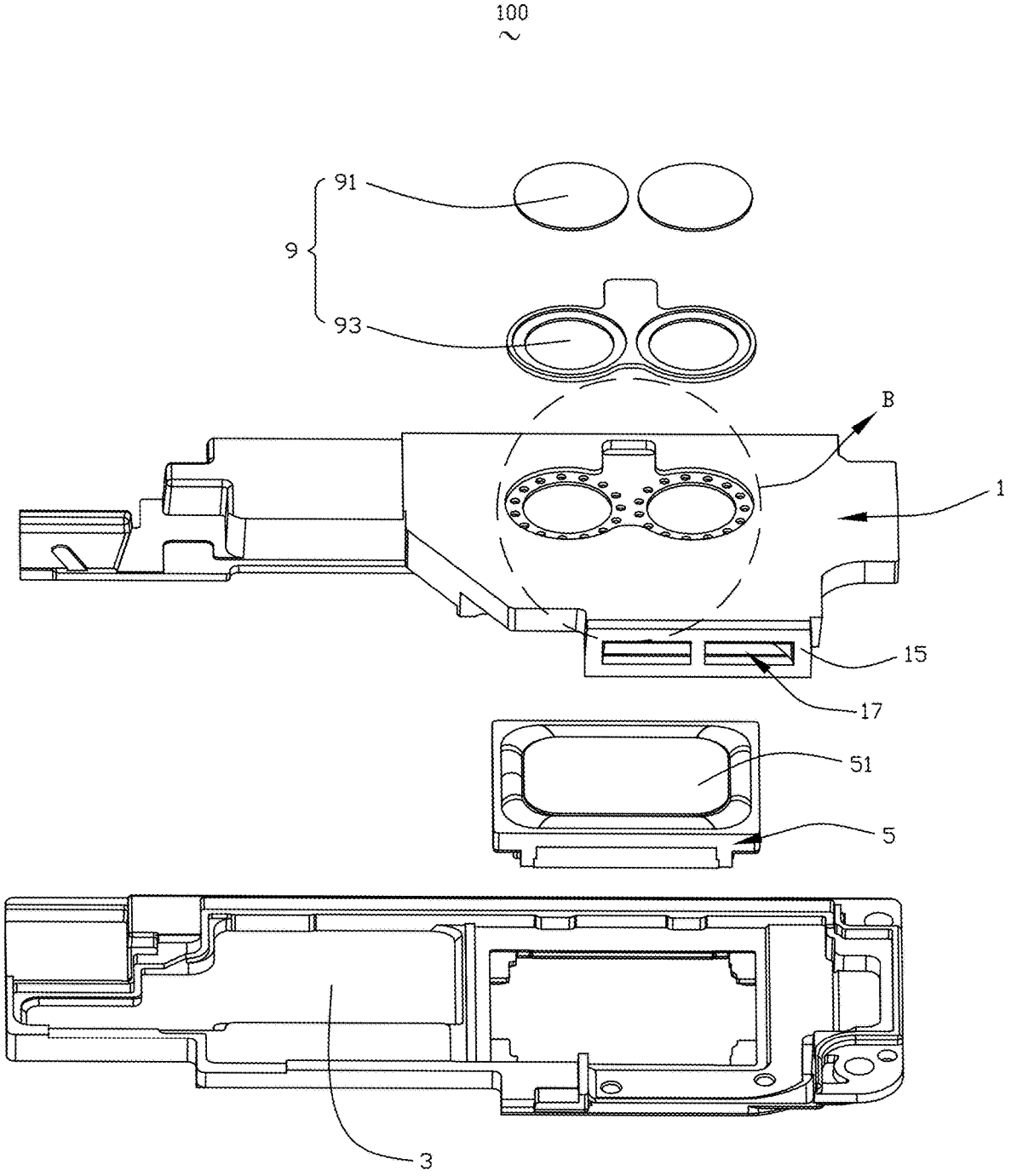
FIG. 2 is a perspective exploded view of the speaker box shown in FIG. 1.
Figure 3:
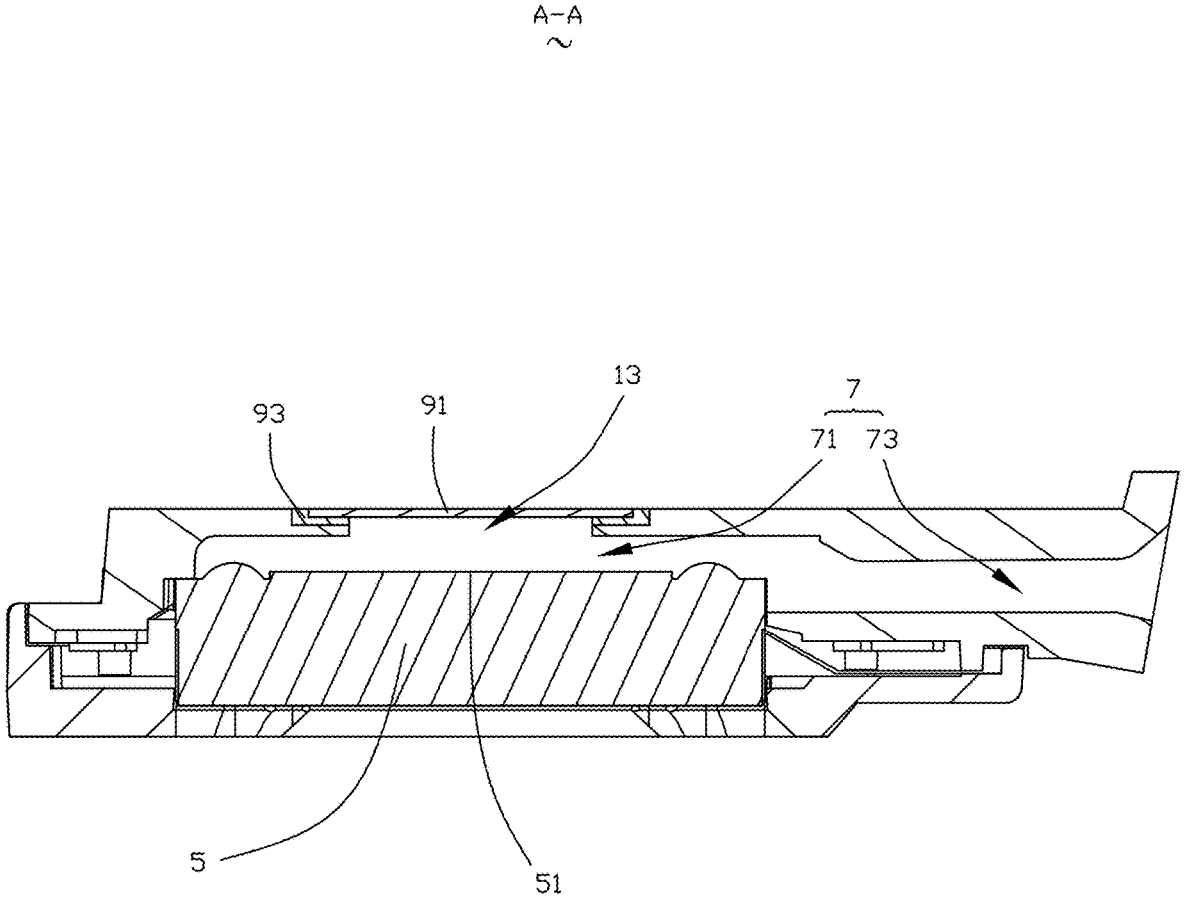
FIG. 3 is a cross-sectional view of the speaker box shown in FIG. 1 taken along line A-A.

Referring to FIGS. 1-3, the speaker box 100 includes an upper cover 1, a lower cover 3 forming an accommodating space together with the upper cover 1, a sounding unit 5 accommodated in the accommodating space, a front chamber 7 enclosed by the upper cover 1 and the sounding unit 5, and a cover plate 9.

The upper cover 1 and the lower cover 3 together enclose a housing of the speaker box 100. The sounding unit 5 is accommodated in the housing.

Figure 4:
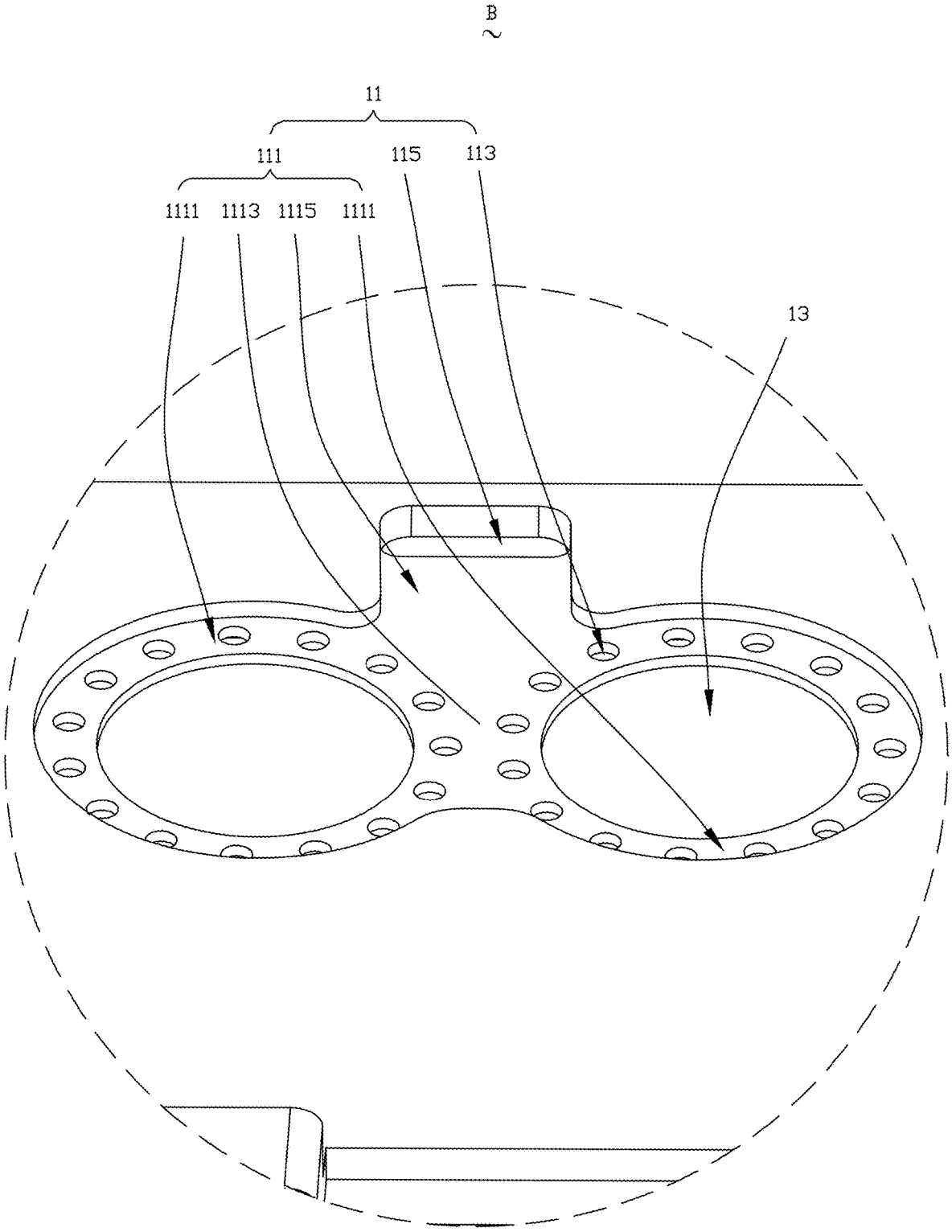
FIG. 4 is an enlarged view of portion B of the speaker box shown in FIG. 2.

Referring to FIG. 4, the upper cover 1 includes a top wall 11 opposite to the lower cover 3, at least two first through-holes 13 penetrating through the top wall 11 and disposed with a spacing therebetween, a side wall 15 bending and extending from the top wall 11 in a direction facing away from the top wall 11, and a sound-emitting outlet 17 provided in the side wall 15 and communicated with the front chamber 7.

The top wall 11 includes a recess 111 formed by being recessed from a surface of the top wall 11 facing away from the sounding unit 5 towards a surface of the top wall 11 close to the sounding unit 5, a plurality of positioning holes 113 penetrating through the recess 111, and a detention slot 115 formed by the recess 111 being recessed towards the sounding unit 5.

The recess 111 includes at least two recess main body portions 1111, a connecting portion 1113 connecting the two adjacent recess main body portions 1111, and an extension portion 1115 extending from the connecting portion 1113 in a direction away from the sound-emitting outlet 17. The first through-holes 13 are provided to be in one-to-one correspondence with the recess main body portions 1111. In the present embodiment, two first through-holes 13 are respectively formed by penetrating through the centers of the two recess main body portions 1111.

The plurality of positioning holes 113 penetrates through the recess main body portion 1111 and is disposed around the first through-hole 13. That is, the plurality of positioning holes 113 is provided on outer side of each first through-hole 13. In an embodiment, the said positioning holes 113 are evenly spaced. The positioning holes 113 are configured to fixedly connecting the cover plate 9 and the top wall 11.

A surface of the extension portion 1115 facing away from the sounding unit 5 is recessed towards a surface close to the sounding unit 5, so as to form the detention slot 115. The detention slot 115 cooperates with the plurality of positioning holes 113 for fixing the cover plate 9 to the top wall 11.

The lower cover 3 and the upper cover 1 are assembled to form the accommodating space, and support the sounding unit 5.

The sounding unit 5, which includes a diaphragm 51, is configured to convert a received electrical signal into an acoustic signal. In an embodiment, the diaphragm 51 is used for vibrating and sounding.

The front chamber 7 includes a front acoustic cavity 71 enclosed by the diaphragm 51 and the upper cover 1, and a sound guiding channel 73 communicating with the front acoustic cavity 71 and the sound-emitting outlet 17. In the present embodiment, the sound guiding channel 73 is formed on the upper cover 1, and the sound-emitting outlet 17 is disposed on the side wall 15, and the speaker box 100 sounds from side face.

The cover plate 9 is disposed on the top wall 11 and covers the first through-holes 13. The cover plate 9 includes a hard sheet 91 covering the first through-holes 13, and a soft rubber fixing portion 93 surrounding the hard sheet 91 and spacing the hard sheet 91 from the top wall 11. The soft rubber fixing portion 93 is fixedly connected with the top wall 11.

By covering the first through-holes 13 with the hard sheet 91, the vibration generated by the diaphragm 31 can be transmitted to the hard sheet 91, and then the effect of vibration on the housing 1 is reduced by the soft rubber fixing portion 93.

The hard sheet 91 can be a steel sheet, an aluminum sheet, a copper sheet, a ceramic sheet or a metal alloy material, and even can be made of plastic having a melting point higher than 300 degrees Celsius.

Figure 5:
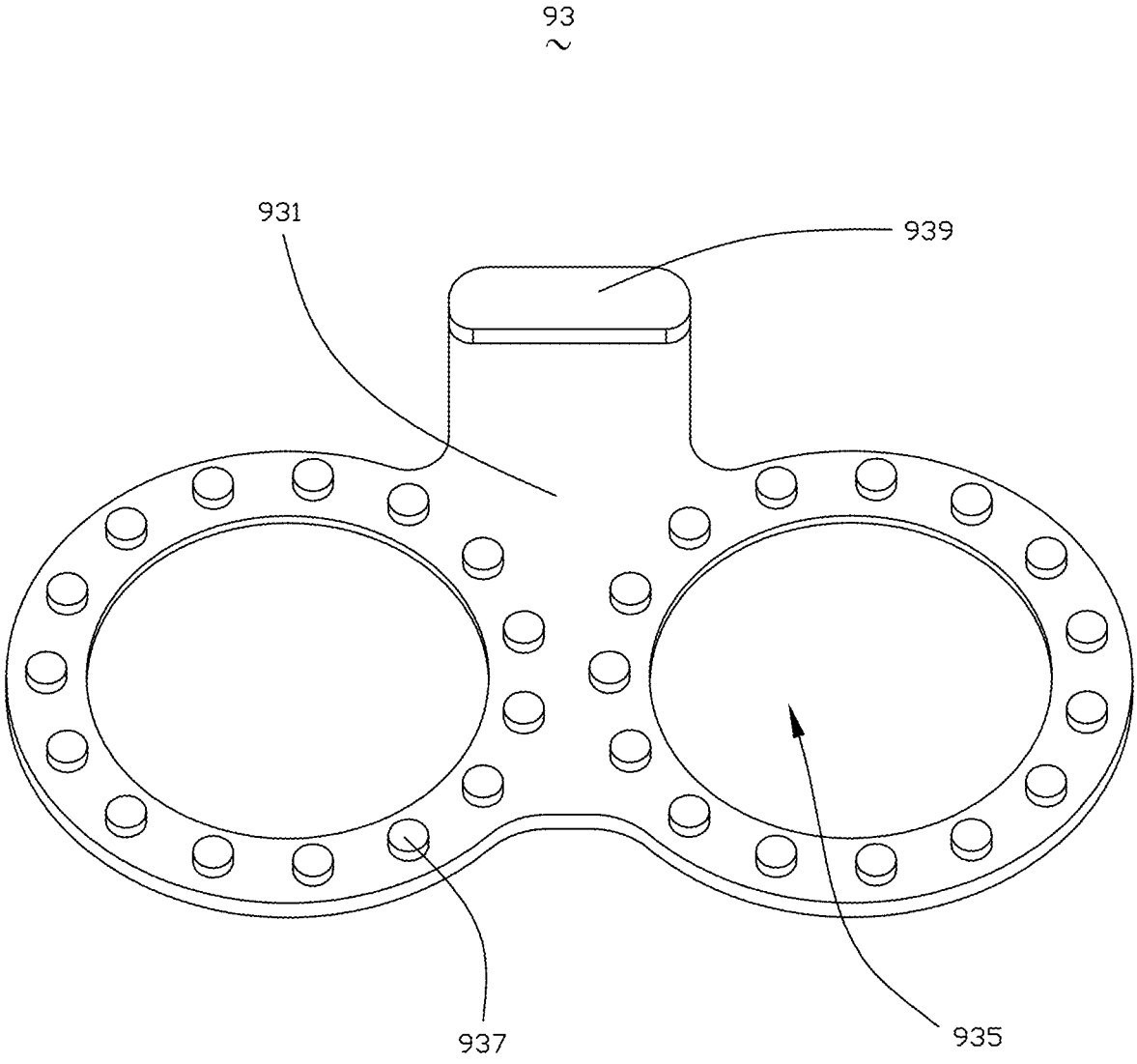
FIG. 5 is a structural schematic diagram of a soft rubber fixing portion of the speaker box shown in FIG. 2 from one perspective.
Figure 6:
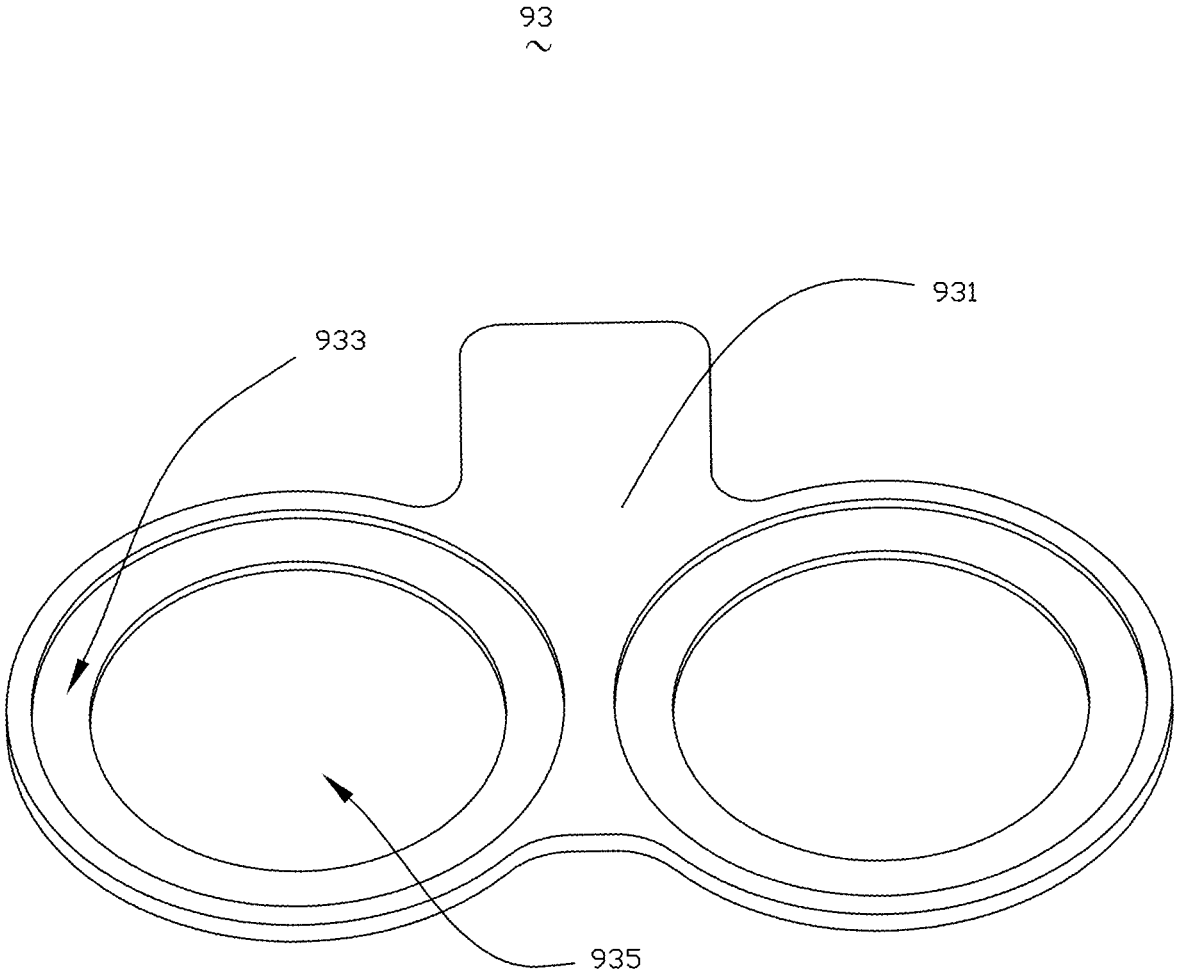
FIG. 6 is a structural schematic diagram of the soft rubber fixing portion of the speaker box shown in FIG. 2 from another perspective.

Referring to FIG. 5 and FIG. 6, the soft rubber fixing portion 93 includes a soft rubber body portion 931 adapted to a shape of the recess 111, a position limiting slot 933, second through-holes 935, a plurality of protrusions 937, and a position limiting portion 939. The position limiting slot 933 is formed by being recessed from a surface of the soft rubber body portion 931 facing away from the sounding unit 5 towards a surface of the soft rubber body portion 931 close to the sounding unit 5. The second through-holes 935 penetrate through the position limiting slot 933 and disposed to be opposite to the first through-holes 13. The plurality of protrusions 937 extends from the soft rubber body portion 931 in a direction towards the sounding unit 5, and corresponds to the positions of the plurality of positioning holes 113. The position limiting portion 939 extends from the soft rubber body portion 931 in the direction towards the sounding unit 5 and corresponds to the detention slot 115.

In an embodiment, the second through-hole 935 is communicated with the front chamber 7 through the first through-hole 13, and the hard sheet 91 is embedded in the position limiting slot 933 and covers the second through-hole 935. The plurality of protrusions 937 is accommodated in the plurality of positioning holes 113, respectively, and the position limiting portion 939 is engaged in the detention slot 115.

In a preferable embodiment, the second through-hole 935 and the first through-hole 13 are circular through-holes having the same aperture, and a central axis of the second through-hole 935 and a central axis of the first through-hole 13 are on the same line.

The soft rubber fixing portion 93 can be made of silica gel, thermoplastic polyurethane elastomer rubber, thermoplastic elastomer, thermoplastic styrene butadiene rubber, thermoplastic vulcanized rubber, or chlorinated polyethylene. In another embodiment, the soft rubber fixing portion 93 can be replaced by a fixing portion made of a cushioning foam material.

In an embodiment, the surface of the soft rubber body portion 931 facing away from the sounding unit 5, the surface of the top wall 11 facing away from the sounding unit 5, and the surface of the hard sheet 91 facing away from the sounding unit 5 are on the same plane.

In the present embodiment, the cover plate 9 and the housing 1 are formed as one piece by two-color injection molding process. However, the present disclosure is not limited to this, and other processes which can achieve the same effect also fall within the scope of the present disclosure.

It should be noted that, in the present embodiment, a number of the first through-holes 13 and a number of the hard sheets 91 both are two, but not limited to two. That is, the number of the first through-holes 13 and the number of the hard sheets 91 can be adjusted depending on requirements on the acoustic performance of the speaker box 100. Similarly, e dimensions of the soft rubber fixing portion 93 and the hard sheet 91 are not specifically limited in the present disclosure, and the dimensions of the soft rubber fixing portion 93 and the hard sheet 91 can be adjusted depending on a required frequency response of the speaker box 100.

Compared with the related art, by providing the cover plate 9 in the region of the top wall 11 corresponding to the front chamber 7, the speaker box 100 of the present disclosure can achieve the following objects. On the one hand, the soft rubber fixing portion 93 can exert a cushioning effect when the sounding unit 5 operates, thereby ensuring the stability of the operation of the speaker box 100. On the other hand, the loudness of the speaker box 100 in different frequency bands can be changed by adjusting the dimension, material and number of the soft rubber fixing portion 93 and the hard sheet 91.

The embodiments described above are merely illustrative. It should be understood that those skilled in the art can make improvements without departing from the concept of the present disclosure, but all of them fall into the protection scope of the present disclosure.

What is claimed is:

1. A speaker box, comprising:

a housing having a top wall;

a sounding unit accommodated in the housing and comprising a diaphragm for vibrating and sounding, the diaphragm and the top wall being disposed with a spacing therebetween to form a front acoustic cavity;

a sound guiding channel, the front acoustic cavity communicating with outside through the sound guiding channel, and the front acoustic cavity and the sound guiding channel together constituting a front chamber of the speaker box, wherein at least two first through-holes penetrating through the top wall and disposed with a spacing therebetween are provided in a region of the top wall corresponding to the front chamber; and a cover plate provided on the top wall, wherein the cover plate comprises hard sheets covering the at least two first through-holes and a soft rubber fixing portion surrounding the hard sheets and spacing the hard sheets from the top wall, and the soft rubber fixing portion is fixedly connected with the top wall; wherein, the top wall comprises a recess recessed from a surface of the top wall facing away from the sounding unit towards a surface of the top wall close to the sounding unit, the recess comprises at least two recess main body portions, a connecting portion for connecting two adjacent recess main body portions of the at least two recess main body portions, and an extension portion extending from the connecting portion in a direction away from the sound guiding channel, and the at least the two first through-holes are each formed by penetrating through centers of the at least two recess main body portions, and the at least two recess main body portions are in one-to-one correspondence with the at least two first through-holes.

2. The speaker box as described in claim 1, wherein the soft rubber fixing portion comprises: a soft rubber body portion adapted to a shape of the recess; a position limiting slot recessed from a surface of the soft rubber body portion facing away from the sounding unit towards a surface of the soft rubber body portion close to the sounding unit; and second through-holes penetrating through the position limiting slot and disposed opposite to the at least two first through-holes, and the second through-holes communicate with the front chamber through the at least two first through-holes, and the hard sheets are embedded in the position limiting slot and cover the second through-holes.

3. The speaker box as described in claim 2, wherein a surface of each of the hard sheets facing away from the sounding unit is in a same plane as a surface of the soft rubber body portion facing away from the sounding unit.

4. The speaker box as described in claim 2, wherein the top wall further comprises a plurality of positioning holes penetrating through the at least two recess main body portions and surrounding the at least two first through-holes, and the soft rubber fixing portion further comprises a plurality of protrusions extending from the soft rubber body portion towards the sounding unit, and each of the plurality of protrusions corresponds to and is accommodated in one of the plurality of positioning holes.

5. The speaker box as described in claim 4, wherein the top wall further comprises a detention slot recessed from a surface of the extension portion facing away from the sounding unit towards a surface of the extension portion close to the sounding unit, and the soft rubber fixing portion further comprises a position limiting portion extending from the soft rubber body portion towards the sounding unit, and the position limiting portion corresponds to the detention slot and is engaged in the detention slot.

6. The speaker box as described in claim 2, wherein the at least two first through-holes and the second through-holes are circular through-holes having a same aperture, and a central axis of each of the at least two first through-holes and a central axis of each of the second through-holes are on a same straight line.

7. The speaker box as described in any one of claim 1, wherein the soft rubber fixing portion is made of silica gel, thermoplastic polyurethane elastomer rubber, thermoplastic elastomer, thermoplastic styrene butadiene rubber, thermoplastic vulcanized rubber or chlorinated polyethylene.

8. The speaker box as described in claim 7, wherein the cover plate and the housing are formed in one piece by a two-color injection molding process.

9. The speaker box as described in claim any one of claim 1 wherein each of the hard sheets is a steel sheet, an aluminum sheet, a copper sheet, a ceramic sheet, a sheet made of a metal alloy material, or a sheet made of plastic having a melting point higher than 300 degrees Celsius.

* * * * *